US006213162B1

(12) United States Patent
Baechtold

(10) Patent No.: US 6,213,162 B1
(45) Date of Patent: Apr. 10, 2001

(54) WEAVING HEDDLE HAVING END EYES FORMED BY PRESSING

(75) Inventor: Julius Baechtold, Wilen-Wollerau (CH)

(73) Assignee: Grob Horgen AG (CH)

( * ) Notice: Subject to any disclaimer, the term of this patent is extended or adjusted under 35 U.S.C. 154(b) by 0 days.

(21) Appl. No.: 09/525,911

(22) Filed: Mar. 15, 2000

(51) Int. Cl.[7] ..... D03C 9/04
(52) U.S. Cl. ..... 139/93; 140/72
(58) Field of Search ..... 140/72; 139/93

(56) References Cited

U.S. PATENT DOCUMENTS

| | | | | |
|---|---|---|---|---|
| 748,713 | | 1/1904 | Fehr . | |
| 1,517,129 | * | 11/1924 | Ruegg | 139/93 |
| 3,049,151 | * | 8/1962 | McFetters | 139/93 |
| 5,699,836 | * | 12/1997 | Golz | 139/93 |

FOREIGN PATENT DOCUMENTS 180525 9/1905 (DE) .

* cited by examiner

*Primary Examiner*—Andy Falik
(74) *Attorney, Agent, or Firm*—Dykema Gossett PLLC

(57) ABSTRACT

A weaving heddle formed of a strip of material has end eyes adjacent opposing end sections of the heddle and a central thread eyelet. The spaced apart legs forming the long sides of the heddle eyes extend transversely outwardly of the opposing edges of the strip from which the heddle is made, and in the area of at least one of the short sides of the rectangular end eye is an auxiliary squeeze-pressed section at a spaced apart distance therefrom providing a separating ridge located between the short side of the end eye and the auxiliary pressed section(s). The ridge is oriented such that its base is perpendicular to the longitudinal axis of the heddle.

18 Claims, 1 Drawing Sheet

WEAVING HEDDLE HAVING END EYES FORMED BY PRESSING

BACKGROUND OF THE INVENTION

This invention relates a weaving heddle made of a strip material and a process for making the heddle. The invention relates more particularly to the formation of the heddle end eyes which, as known, permit the heddles to be lined up and hung in heddle frames.

It is known that weaving heddles have been used for many years in many weaving mills and it is not surprising that certain limits in efficiency have been reached. Since the cross-sectional dimensions of the metal strip used in making the weaving heddle have essentially remained unchanged, the cost of polishing remains low. Moreover unhardened steel strip material has been utilized in most cases. Both such factors allow for the production of a low cost heddle but also one which is not particularly efficient. Even with the great advancements in the weaving technology, such heddles are still used in very modern facilities because the mechanical life-span of the heddles is about the same as the limited useful life of the thread eyelet. The thread eyelet may however become damaged by modern synthetic fibers quite quickly to a degree that weaving is not made possible. Even more expensive materials such as hardened steel do not produce in most cases improved conditions in proportion to the higher expense. Thus there is a great deal of interest in the textile industry for a more efficient design of the traditional type of heddle.

Such heddles as they are currently used in great numbers, are generally disclosed in detail in U.S. Pat. No. 748,713. The end eyes as therein described are made by punching out an elongated rectangular opening from the strip. Thereafter the narrow sides of the opening are squeezed-pressed resulting in the longitudinal sides being deformed and the opening being enlarged. One disadvantage is the formation of wedge-shaped pressed areas at the narrow sides of the opening. These make contact with the heddle slide bar that runs through the openings such that these areas become damaged quite quickly thereby rendering the heddles unserviceable.

German patent 180525 discloses an improvement over the U.S. Pat. No. 748,713 in the formation of heddle end eyes by first deforming the area of the end eye by squeeze-pressing it into the desired width and then punching out the weakened sections so formed. It appears that a substantially strengthened end eye is produced by the removal of the thin pressed sections. However, formation of the end eyes according to such a method can be realized with only a very soft original material which diminishes the overall advantages offered by the end formation technique.

SUMMARY OF THE INVENTION

It is an object of the present invention to provide a weaving heddle having end eyes formed in a manner which improves upon that of German 180525 and which the strip of material from which the heddle is made is substantially stronger to thereby meet the requirements of modern day weaving mills.

In accordance with the invention a weaving heddle is made of an elongated strip of material having squeeze-pressed and punched out end sections forming end eyes adjacent the terminal ends of the strip. Each of the end eyes is defined by a pair of spaced apart side legs lying parallel to the longitudinal axis of the strip. The side legs have outer edges extending laterally outwardly of opposed outer edges of the remainder of the strip. And at least one of the opposing faces of the strip has at least one deformation defining an indentation adjacent one end of each of the end eyes.

In the production of the weaving heddle according to the invention, there is provided at first a squeeze-pressed section oriented in a longitudinal direction in the area of the end eye to be formed, and preferably lying along the longitudinal axis of the strip such that the strip is widened in the area of the end eye to be formed, and the end eye is formed by subsequently punching out the strip material at the squeeze-pressed section. An additional squeeze-pressed section is applied simultaneously at a distance from a short end of the eye to be formed, and preferably additional pressed sections are formed at distances from both short sides of the eyes to be formed. Thus three squeeze-pressed sections are formed in the area of end eye to be formed. When such squeeze-pressed sections are formed simultaneously, each end eye is subsequently formed by punching out the squeezed material from that pressed section of the eye to be formed.

Between the three pressed sections, there remain two narrow ridges for areas that are undeformed. The two auxiliary pressed sections adjacent the short ends of the end eye as formed function to extend the area from the widest section of the deformed end eye to the non-deformed strip to thereby minimize the development of any stresses in the material. In other words the auxiliary pressed sections which form deformations provide for elongated and smoother transitions between the widened section of the strip from which the end eye is formed, and the undeformed portions of the strip. Moreover the two auxiliary pressed sections may be shaped in such a manner that the ridges are slightly puffed so that the thickness, even with the widening of the strip in this area, correspond approximately with the thickness of remaining strip. The end eyes are formed by punching out the middle squeeze-pressed section, the punched areas overlapping the slightly pushed-up ridges so that a large bearing surface for the heddle slide bar is formed. This relatively large bearing surface prevents premature material wear. Thus in addition to using strip material with increased stability, the heddle produced according to the invention meets stress requirements found in the modern day weaving mills.

DETAILED DESCRIPTION OF THE INVENTION

Figure 1:
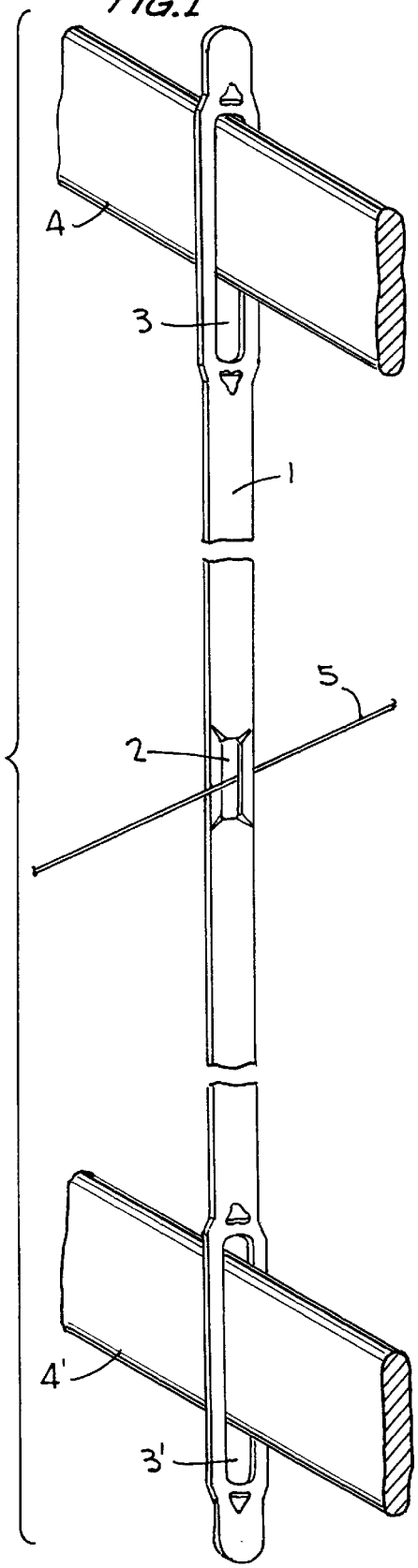
FIG. 1 is a perspective longitudinal view of a heddle formed according to the invention as shown hanging on the heddle slide bars of a weaving frame.

FIG. 1 shows heddle 1 formed according to the invention as it is lined up on the heddle slide bars 4, 4' of a weaving heddle frame not otherwise shown. The heddle has a typical central thread eyelet 2 and end eyes 3, 3' at opposing end portions of the heddle. A warp thread 5 is shown guided through thread eyelet 2 as in the normal and known manner.

Figure 2:
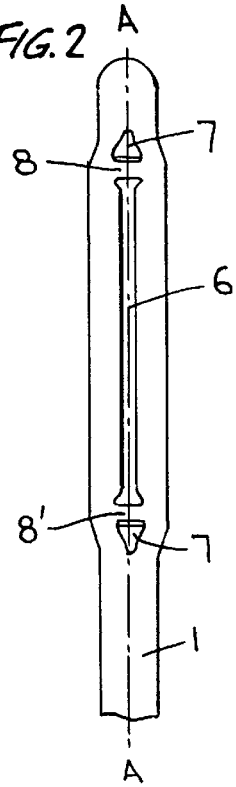
FIG. 2 is a plan view of a typical end section of the weaving heddle of FIG. 1.

A typical end section of heddle 1 is shown in FIG. 2 as having a middle pressed section 6 and two auxiliary pressed sections 7, 7' formed at spaced distances from the short sides of the rectangularly shaped middle pressed section 6. The auxiliary pressed sections 7, 7' respectively form ridges 8, 8' which are not squeeze-pressed but are slightly pushed up. Middle pressed section 6 is formed by pressing together, as by cold forming, localized areas at opposing faces of the strip of material from which the heddle is formed or initially forming opposed elongated indentations lying along the longitudinal axis of the heddle/strip as shown. The auxiliary pressed sections 7, 7' are formed respectively adjacent the short sides of the heddle pressed section 6 by applying deformations to at least one of the opposing faces of the strip to define indentations as shown adjacent at least one end of each end eye.

As clearly seen in FIG. 2, the strip of material of heddle 1 is widened by the formation of the middle pressed section 6 in the area of the future end eye opening. Even with a widening effected by squeeze-pressing, the opposed pair of legs oriented along the sides of the middle pressed section 6 are at an unreduced thickness relative to the thickness of the remainder of the strip of material of the heddle, as clearly shown in FIG. 3.

Figure 3:
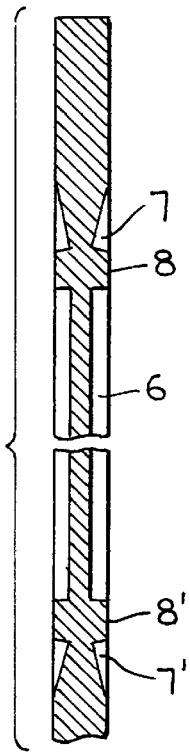
FIG. 3 is a cross-sectional view taken substantially along the line A—A of FIG. 2.

Clearly visible in FIG. 3 are the central pressed section 6 forming indentations at opposing sides of the strip for the formation of the future end eye openings, as well as the auxiliary pressed sections 7, 7' which likewise form indentations in opposing faces of the strip. And it can be seen that the auxiliary pressed sections 7, 7' are shaped in such a manner that in the longitudinal direction displaced material of ridges 8, 8' so formed are slightly pushed up relative to the non-deformed strip material.

Figure 4:
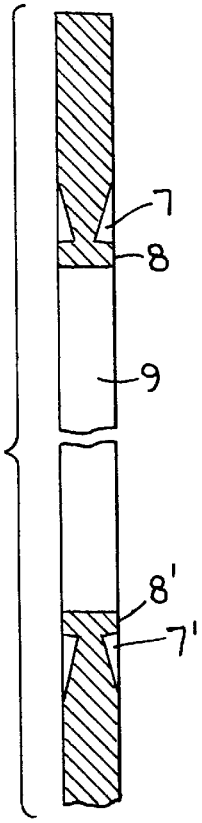
FIG. 4 is a cross-sectional view similar to FIG. 3 after the deformed portion forming the end eye has been punched out.

In FIG. 4 the middle squeeze-pressed section 6 has been shown punched out to remove the middle squeeze-pressed portion together with adjoining portions of ridges 8, 8', as shown, thus providing large bearing surfaces for the heddle slide bear which tend to prevent premature material wear. Also it can be seen that the auxiliary squeeze-pressed sections 7, 7' are not punched out and that the thickness of ridges 8, 8' remain substantially the same as the thickness of the non-deformed remainder of the strip material. However, ridges 8, 8' may be so formed that their thickness is slightly greater than the thickness of the non-deformed remainder of strip material.

Figure 5:
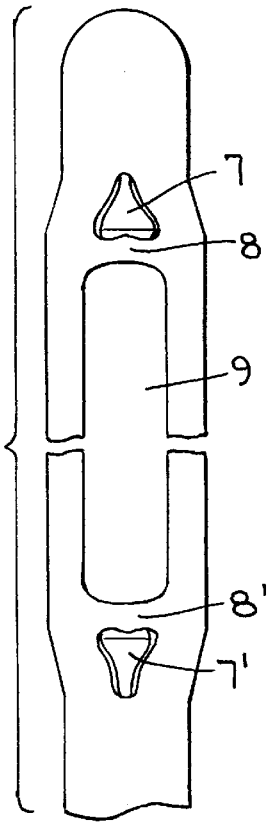
FIG. 5 is an enlarged view similar to that of FIG. 2 illustrating the complete punched out end eye of the heddle.

FIG. 5 illustrates the completed end eye section at an end of the heddle which is typical for the opposite end as well. It can be seen that by forming the two auxiliary pressed together sections 7, 7' the transition area of the widened strip in the area of the end eye relative to the non-deformed strip section of the heddle remains relatively straight and whereby the transition area is additionally strengthened by forming the two ridges 8, 8'. In contrast to the state-of-the-art of known designs of end eyes with widened strips, the innovative design of the strip material according to the invention leads to increased stability such that a heddle is formed that meets the stress requirements found in modern day weaving mills.

The formation of each end eye with corresponding squeeze-pressed auxiliary sections shown in FIGS. 1 to 5 is of course only an example to permit a better understanding of the present invention. It also possible for example, to provide an auxiliary pressed section 7, 7' adjacent only one of the short sides of the middle pressed section of the eye to be formed. And it is possible to provide the auxiliary pressed section or sections 7, 7' to form an indentation at only one of the opposing faces of the strip from which the heddle is formed, without departing from the invention. Also the method of providing the squeeze-pressed sections is not critical to the invention but maybe carried out by cold forming.

The strip of material from which the heddle is made may comprise thermally hardened steel. The strip may otherwise comprise super hardened steel formed by cold forming.

Obviously many other modifications and variations of the present invention are made possible in the light of the above teachings. It is therefore to be understood that within the scope of the appended claims the invention may be practiced otherwise than as specifically described.

What is claimed is:

1. A weaving heddle comprising, an elongated strip of material having an initial constant width extending between opposing terminal ends thereof, said strip having squeeze pressed and punched out end sections forming end eyes adjacent said terminal ends, each said end eye having opposing ends and each said end eye being defined by a pair of spaced apart side legs lying parallel to the longitudinal axis of the strip, said side legs having outer edges extending laterally outwardly of opposed outer edges of said strip defining said constant width, and at least one of opposing faces of said strip having at least one auxiliary pressed section adjacent one of said opposing ends of each of said end eyes.

2. The heddle according to claim 1, wherein said at least one of said opposing faces has a pair of auxiliary pressed sections respectively adjacent said opposing ends of said end eyes.

3. The heddle according to claim 1, wherein said end eyes are elongated and lie along said axis, and each of said end eyes being substantially rectangular.

4. The heddle according to claim 2, wherein said indentations are triangular in shape, a base of each of said auxiliary indentations lying perpendicular to said axis and being spaced from said opposing ends of said end eyes to thereby define ridges.

5. The heddle according to claim 4, wherein said ridges are of substantially the same thickness as that of said strip.

6. The heddle according to claim 4, wherein said ridges are of a thickness greater than that of said strip.

7. The heddle according to claim 6, wherein opposing faces of said strip have auxiliary pressed sections adjacent said opposing ends of each of said end eyes.

8. The heddle according to claim 1, wherein opposing faces of said strip have auxiliary pressed sections adjacent said opposing ends of each of said end eyes.

9. The heddle according to claim 1, wherein said strip comprises thermally hardened steel.

10. The heddle according to claim 1, wherein said strip comprises super hardened steel formed by cold forming.

11. A process of making end eyes of a weaving heddle having a central thread eyelet, comprising the steps of:

providing an elongated strip of material having an initial constant width and having opposing faces;

compressing together localized areas at opposing faces of the strip at end sections thereof for initially forming opposed elongated indentations lying along a longitudinal axis of the strip;

forming side legs by the compressing step at said indentations such that outer edges of said side legs extending laterally outwardly of opposed outer edges of said strip defining said constant width;

punching out the material at said elongated indentations to form said end eyes at said end sections with each of said end eyes having opposing ends, and applying at least one deformation to at least one of said opposing faces of said strip to define an auxiliary indentation adjacent one of said opposing ends of each of said end eyes.

12. The process according to claim 11, wherein the applying step further comprises the application of deformations to said at least one of said opposing faces defining auxiliary indentations respectively adjacent opposing ends of said end eyes.

13. The process according to claim 12, wherein said auxiliary indentations are formed substantially triangular in shape, a base of each of said auxiliary indentations lying perpendicular to said axis and being spaced from said opposing ends of said end eyes to thereby define ridges.

14. The process according to claim 13, wherein said ridges are formed of substantially the same thickness as that of said strip.

15. The process according to claim 13, wherein said ridges are formed of a thickness greater than that of said strips.

16. The process according to claim 15, wherein the applying step further comprises the application of deformations to one of said opposing faces of said strip defining auxiliary indentations adjacent opposing ends of each of said end eyes.

17. The process according to claim 11, wherein the applying step further comprises the application of deformations to opposing faces of said strip defining auxiliary indentations adjacent opposing ends of each of said end eyes.

18. The process according to claim 11, wherein the compressing and applying steps are carried out by cold forming.

* * * * *

UNITED STATES PATENT AND TRADEMARK OFFICE

CERTIFICATE OF CORRECTION

PATENT NO. : 6,213,162 B1
DATED : April 10, 2001
INVENTOR(S) : Julius Baechtold

It is certified that error appears in the above-identified patent and that said Letters Patent is hereby corrected as shown below:

Title page,
Insert item [30] Foreign Application Priority Data
March 19, 1999 [DE] Germany.....199 12 419.13

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,213,162 B1
DATED : April 10, 2001
INVENTOR(S) : Julius Baechtold

It is certified that error appears in the above-identified patent and that said Letters Patent is hereby corrected as shown below:

Title page,
Insert Item [30], Foreign Application Priority Data
March 19, 1999 [DE] Germany.....199 12 419.1

This certificate supersedes certificate of correction issued August 28, 2001

Signed and Sealed this

Twenty-ninth Day of January, 2002

*Attest:*

*Attesting Officer*

JAMES E. ROGAN
*Director of the United States Patent and Trademark Office*